US006913299B1

(12) United States Patent
Stendal

(10) Patent No.: US 6,913,299 B1
(45) Date of Patent: Jul. 5, 2005

(54) CLOSING SHEET FOR ESCAPE DOORS

(75) Inventor: Jan Stendal, Västerås (SE)

(73) Assignee: Stendals Elektriska AB, Vasteras (SE)

( * ) Notice: Subject to any disclaimer, the term of this patent is extended or adjusted under 35 U.S.C. 154(b) by 0 days.

(21) Appl. No.: 10/239,029

(22) PCT Filed: Aug. 17, 2000

(86) PCT No.: PCT/SE00/01585

§ 371 (c)(1),
(2), (4) Date: Sep. 18, 2002

(87) PCT Pub. No.: WO01/16447

PCT Pub. Date: Mar. 8, 2001

(30) Foreign Application Priority Data

Aug. 30, 1999 (SE) ..... 9903045

(51) Int. Cl.[7] ..... E05B 15/02

(52) U.S. Cl. ..... 292/341.15; 292/92; 292/340; 292/341.16; 70/92

(58) Field of Search ..... 292/92, 93, 341.15, 292/DIG. 65, DIG. 66, 34, 341.11–341.19; 70/92, 93, 142, 150, 151 R, 157, 107, 432, 70/DIG. 59, 278.7

(56) References Cited

U.S. PATENT DOCUMENTS

| | | | | | |
|---|---|---|---|---|---|
| 352,154 | A | * | 11/1886 | Rousseau | 292/341.16 |
| 3,638,984 | A | * | 2/1972 | Davidson | 292/341.16 |
| 3,640,560 | A | * | 2/1972 | Zawadzki et al. | 292/341.16 |
| 3,774,422 | A | * | 11/1973 | Hogan et al. | 70/264 |
| 3,861,727 | A | * | 1/1975 | Froerup et al. | 292/341.16 |
| 3,910,617 | A | * | 10/1975 | Scalza et al. | 292/341.16 |
| 4,015,869 | A | * | 4/1977 | Horvath | 292/341.16 |
| 4,017,107 | A | * | 4/1977 | Hanchett | 292/341.16 |
| 4,026,589 | A | * | 5/1977 | Hanchett, Jr. | 292/341.16 |
| 4,056,277 | A | * | 11/1977 | Gamus et al. | 292/341.16 |
| 4,529,234 | A | * | 7/1985 | Senften | 292/169.15 |
| 4,595,220 | A | * | 6/1986 | Hanchett et al. | 292/341.17 |
| 4,626,010 | A | * | 12/1986 | Hanchett et al. | 292/341.16 |
| 4,717,909 | A | * | 1/1988 | Davis | 340/686.4 |
| 4,904,005 | A | * | 2/1990 | Frolov | 292/251.5 |
| 5,040,331 | A | | 8/1991 | Merendino et al. | |
| 5,195,792 | A | * | 3/1993 | Stendal | 292/341.16 |
| 5,474,342 | A | * | 12/1995 | Smith et al. | 292/254 |
| 5,484,180 | A | * | 1/1996 | Helmar | 292/341.16 |

(Continued)

FOREIGN PATENT DOCUMENTS

| | | |
|---|---|---|
| WO | WO 96/22578 | 8/1996 |
| WO | 9841717 | 9/1998 |

*Primary Examiner*—David E. Bochna
*Assistant Examiner*—Carlos Lugo
(74) *Attorney, Agent, or Firm*—Harness, Dickey & Pierce, P.L.C.

(57) ABSTRACT

The present invention relates to a locking device for doors with mortise sashlock and remote-controlled door opener or pull or push plates, intended to be openable without being influenced by the spring bolt. The invention is characterized in that the lock also comprises a stop (6) to achieve a blocking position for the spring bolt (3), which stop in closed position, with the dead-bolt in locking position keeps the stop in inactive position, and with the dead-bolt in unlocked position releases the stop to a position where, in cooperation with the spring bolt (3), it keeps the door closed.

4 Claims, 2 Drawing Sheets

U.S. PATENT DOCUMENTS 5,735,559 A * 4/1998 Frolov ..... 292/341.16
5,757,269 A * 5/1998 Roth et al. ..... 340/542
5,782,509 A 7/1998 Uyeda
5,825,288 A * 10/1998 Wojdan ..... 340/542
6,085,465 A * 7/2000 Olberding et al. ..... 49/460
6,179,351 B1 * 1/2001 Stendal ..... 292/137
6,568,726 B1 * 5/2003 Caspi et al. ..... 292/341.16

* cited by examiner

CLOSING SHEET FOR ESCAPE DOORS

TECHNICAL FIELD

The present invention relates to a striking plate for doors with mortise sashlock and remote-controlled door opener or opening pull or push plates, intended to be openable without being influenced by the spring bolt, e.g. fire doors.

BACKGROUND ART

Fire doors are frequently provided with mechanical door locks having dead-bolts and spring bolts. These doors are used to prevent a fire spreading in the building. The door is designed to prevent a fire that has started from spreading, regardless of whether the dead-bolt is tripped in the striking plate or not, the door being kept closed by the spring bolt of the door lock having an inclined surface in the closing direction of the door. In the same way, the bolt shall be capable of keeping the door closed in the event of fire, regardless of whether the spring bolt is blocked or not. The fire door can also be provided with an electric striking plate as described in Swedish patent Nos. 9500582-3 or 9700962-5 together with a lock for a mortise sashlock. A problem therefore arises when the door shall also be opened by an automatic door opener, actuated from a button beside the door. The whole concept of an automatic door opener is lost if the door knob must be used in order to open the door.

THE INVENTION

The present invention relates to a solution of these and similar problems. The striking plate in accordance with the invention is characterized in that it also comprises a stop to achieve a blocking position for the spring bolt which stop, by means of a sensing device actuatable by the dead-bolt, is held in inactive position by the dead-bolt in its locking position, and in its unlocked position is released to a position where, in cooperation with a cover (rotating cam) blocking the spring bolt, it keeps the door closed. The object of this invention is to be able to use a stop for the spring bolt to open position of the sensing device of the tripped dead-bolt when the door is closed. The object of the invention is to be able to use an electric striking plate together with a mortise sashlock when the door shall be automatically openable with a remote-controlled door opener (designed for the disabled) or used with a pull or push plate. The reason for using a mortise sashlock is that its inclined bolt is considered capable of keeping the door closed even if the straight dead-bolt has for some reason been unlocked. The intention is thus to ensure that the door remains closed in the event of a fire, for instance, in order to prevent the fire from spreading. The invention has therefore been provided with a movable indicator which senses that the dead-bolt is in closed position and which influences a stop for the spring bolt so that, when the dead-bolt is unlocked mechanical from the cylinder lock, for instance, the spring bolt will be locked in the rotating cam. This means that the electric striking plate can be unlocked electrically and the door can be opened with the automatic door opener without the handle for the spring bolt having to be used. Since the door is always kept closed by either the dead-bolt or the spring bolt, this combination is capable of keeping the door closed even if a fire should occur.

DRAWINGS

The accompanying drawings show examples of the invention.

FIGS. 1–3 illustrate the blocking arrangement in various positions,

FIGS. 4–5 open and locked position, respectively, for the dead-bolt, and

FIG. 6 shows a general view of the lock in accordance with the invention.

EMBODIMENTS

A complete locking device in accordance with the invention is shown in FIG. 6. An electric striking plate (1) is used together with a mortise 30 sashlock (2) when the door is to be automatically openable by means of a remote-controlled door opener or by means of a pull or push plate. The inclined bolt (3) of the spring bolt is considered capable of keeping the door closed even if the straight dead-bolt (4) has been unlocked for some reason. This ensures that the door is kept closed in the event of a fire, for instance, in order to prevent it from spreading. Conventional striking plates have only one recess for the spring bolt (3) and the mortise sashlock cannot therefore be used when the door is to be opened automatically. The invention has therefore been provided with a movable indicator (5) which senses that the dead-bolt (4) is in the closed position and which influences a first stop (6) for the spring bolt so that, when the dead-bolt has been tripped mechanically from the cylinder lock (11), for instance, the spring bolt is locked in the rotating cam/cover (7).

FIG. 6 shows a locking device in accordance with the invention, provided with an electromagnet (10) which is actuated from a control button situated away from the door. When this button is pushed the rotating cam (8) is released, thus enabling the door to be opened with the dead-bolt (4) in locking position. This bolt (4) is released and, when the door is opened, is moved to the left in FIGS. 4 and 5 to its open position. Through the electrical or mechanical/electrical device (5), a force is transferred to the stop (6), situated beneath the dead-bolt, for the spring bolt (3) in the locking direction of the spring bolt with the rotating cam/cover (7) in front of it, but only when the spring bolt (3) has reached its outermost position to the left is a blocking arrangement (6) for this spring bolt locked. When this position has been reached the rotating cam/cover (7) is locked by means of the previously tensioned spring (13). If the door is then closed without the dead-bolt (4) being in active position, the door will be locked by the spring bolt and can only be opened by means of the pressure handle (12).

If the door is closed with the dead-bolt (4) in an active position, then the indicator (5) will be influenced so that the first stop (6) is opened and the rotating cam/cover (7) is ineffective. The dead-bolt (4) is now locked in the rotating cam (8) by a second stop (9). The dead-bolt (4) now complies with fire requirements.

At an opening signal to the automatic door opener, voltage is emitted to the electro-magnet (10) which opens the stop (9) and the rotating cam (8) is forcibly controlled to open position by the tripped dead-bolt, while the door is simultaneously opened.

The rotating cam (7) is thus blocked and the door is open. This means that the inclined surface of the spring bolt is pressed in and snaps the rotating cam out upon closing.

At the next signal from the electromagnet (10) the stop by the dead-bolt is locked and the door continues to be locked.

FIG. 1 shows the blocked spring bolt (3) when the dead-bolt is unlocked.

FIG. 2 shows the opening movement of the door at the dead-bolt (4), and FIG. 3 shows the stopping device in open position when the dead-bolt (4) is locked.

Figure 1:
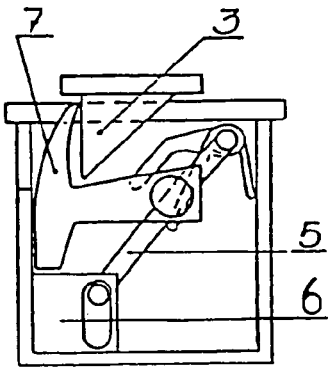
FIGS. 1–3 show the stop device (6) for the spring bolt.
Figure 2:
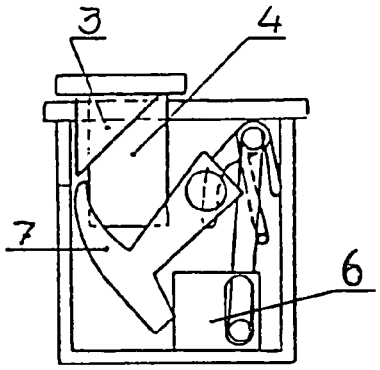
Figure 3:
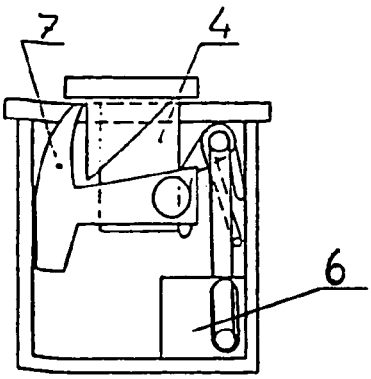
Figure 4:
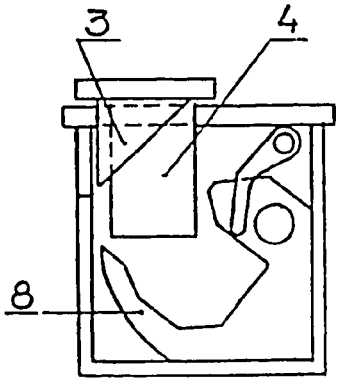
Figure 5:
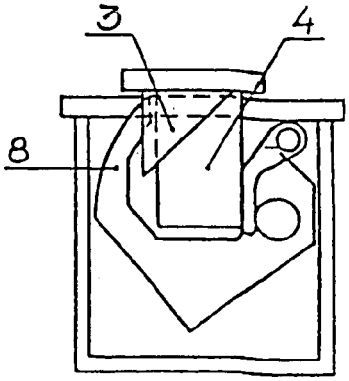
Figure 6:
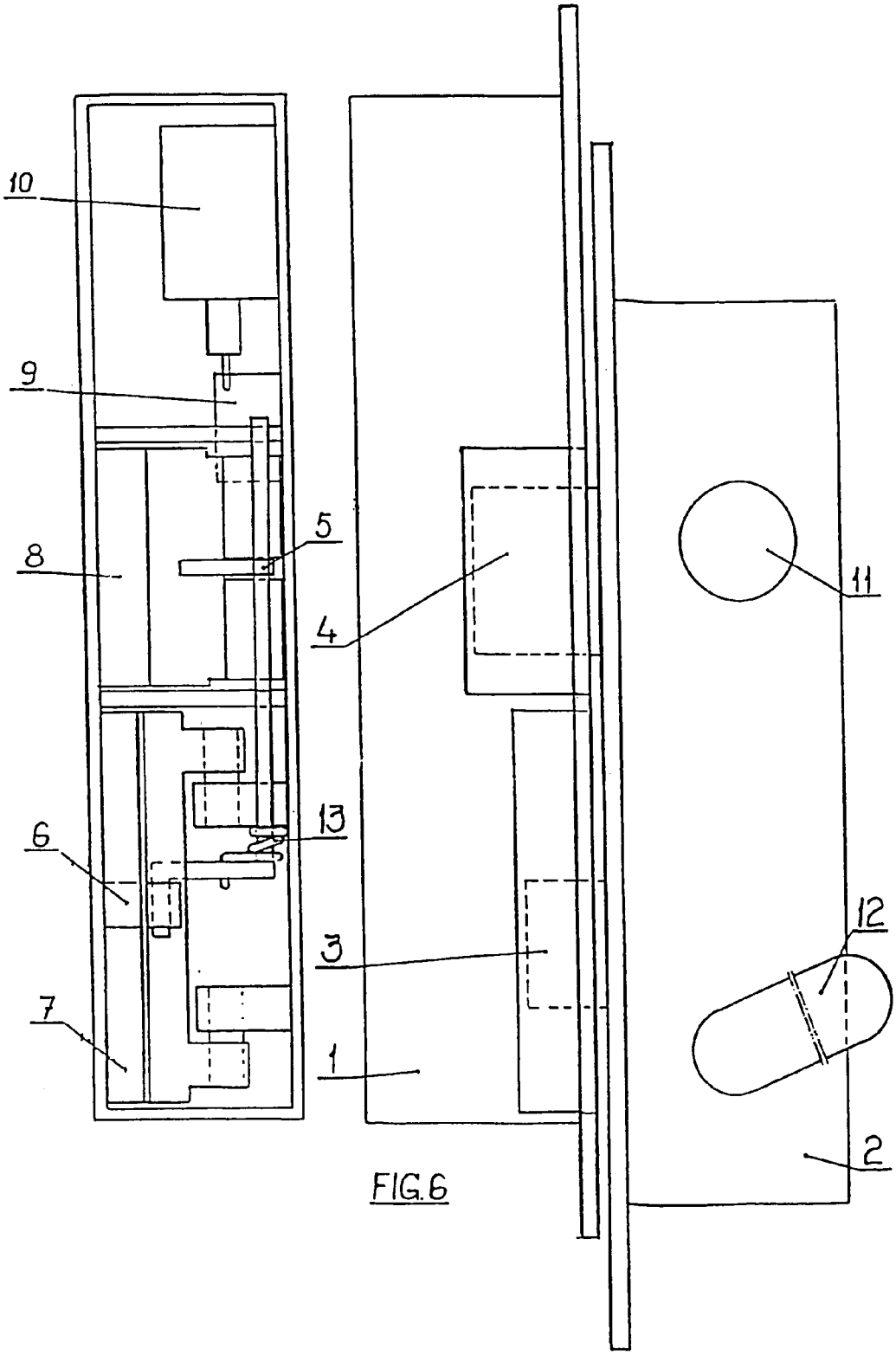

The sensor (5) is arranged to actuate a breaker via electrical link members or mechanical/electrical link members.

A disabled person is thus able to secure the fire door with the aid of the control button and no undesired opening of the door is obtained in the event of a fire. The door handle (12) is not in the proximity of this person and, without the button being pushed, the door cannot be involuntarily opened by forces arising as a result of the fire. The device in accordance with the present invention can be varied in many ways within the scope of the appended claims.

What is claimed is:

1. A striking plate comprising:

a first cam selectively engaging a dead-bolt of a door;

an electromagnetic unit controlling operation of the first cam;

a second cam selectively engaging a spring bolt of the door;

a sensing device sensing whether the dead-bolt of the door is in an unlocked position; and a stop moveable between a first position to block movement of the second cam, and a second position to allow movement of the second cam;

wherein the sensing device moves the stop to the first position when the sensing device senses that the dead-bolt is in the unlocked position.

2. A device as claimed in claim 1, wherein the striking plate is provided with a recess near the spring bolt to enable automatic opening of the door during normal operation.

3. A device as claimed in claim 1, wherein the sensing device is arranged to actuate a breaker in a link.

4. A device as claimed in claim 2, wherein the sensing device is arranged to actuate a breaker in a link.

* * * * *